US006315111B1

(12) United States Patent
Sutherland

(10) Patent No.: US 6,315,111 B1
(45) Date of Patent: Nov. 13, 2001

(54) BASKET CARRIER WITH TOP PANEL

(75) Inventor: Robert L. Sutherland, Kennesaw, GA (US)

(73) Assignee: Riverwood International Corporation, Atlanta, GA (US)

( * ) Notice: Subject to any disclaimer, the term of this patent is extended or adjusted under 35 U.S.C. 154(b) by 0 days.

(21) Appl. No.: 08/969,581

(22) Filed: Nov. 13, 1997

(51) Int. Cl.[7] ..... B65D 71/00
(52) U.S. Cl. ..... 206/188; 206/427
(58) Field of Search ..... 206/141, 188, 206/180, 175, 174, 170, 162, 198, 427

(56) References Cited

U.S. PATENT DOCUMENTS 5,052,552 * 10/1991 Maroszek ..... 206/174
5,400,901 * 3/1995 Harrelson ..... 206/162
5,593,027 * 1/1997 Sutherland ..... 206/170

* cited by examiner

*Primary Examiner*—Jacob K. Ackun

(57) ABSTRACT

A basket-style carrier which includes a top panel. The end panels are comprised of two separate sections, each of which is connected to a center panel, and are spaced from the top panel. The top panel is foldably connected to the side panels and includes a handle. Vertical folds in the end panels allow the end panels to follow the contour of adjacent packaged bottles. In three embodiments the top panel includes bottle neck openings. In a fourth embodiment partial upper end panels connected to the top panel are spaced from the lower end panels. Gusset panels connected to upper end panel flaps and to glue flaps connected to the side panels automatically cause the upper end panel elements to fold into place during the carrier forming operation.

28 Claims, 7 Drawing Sheets

FIG. 2
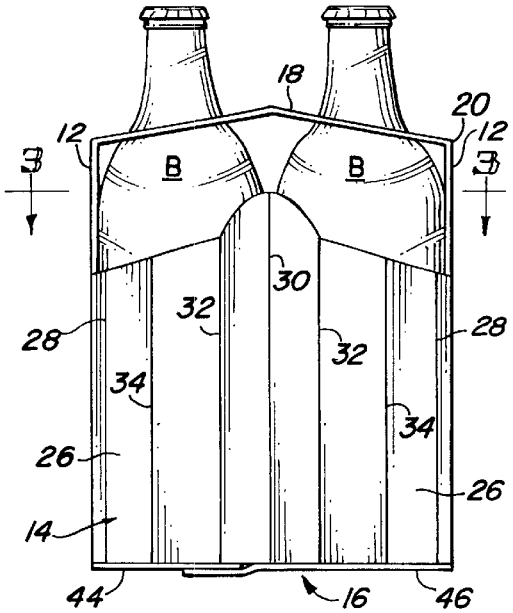
FIG. 3
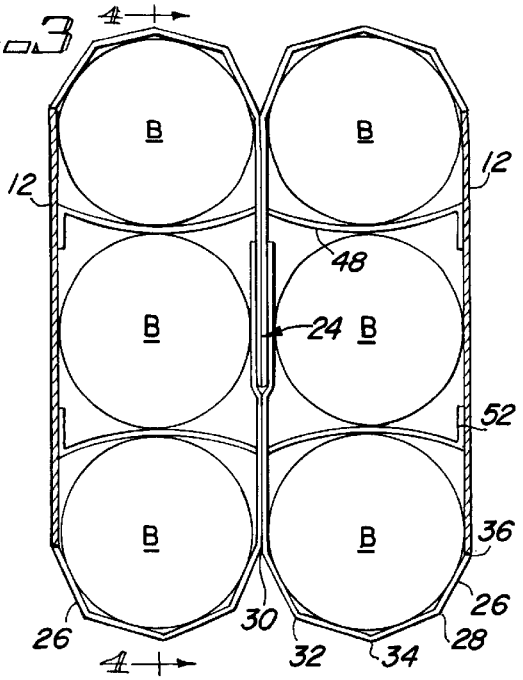
FIG. 6
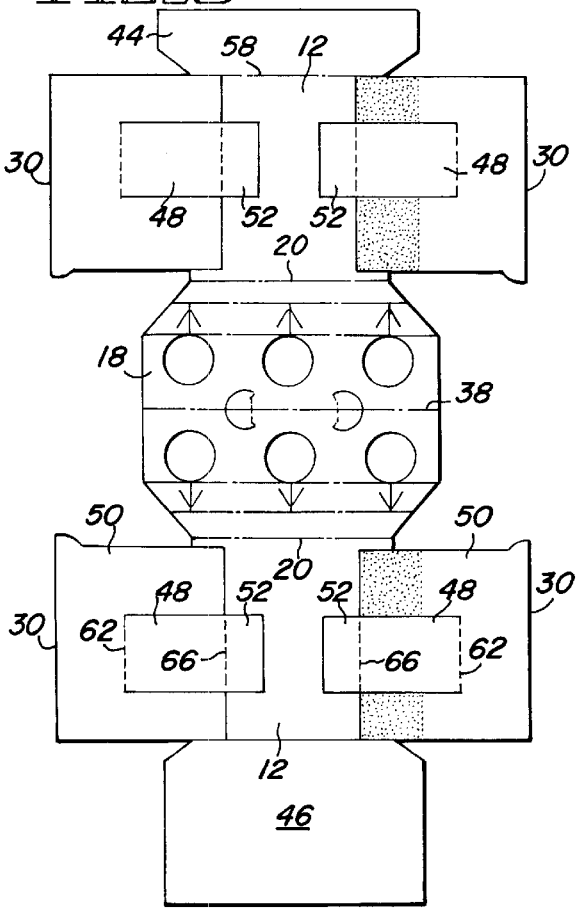
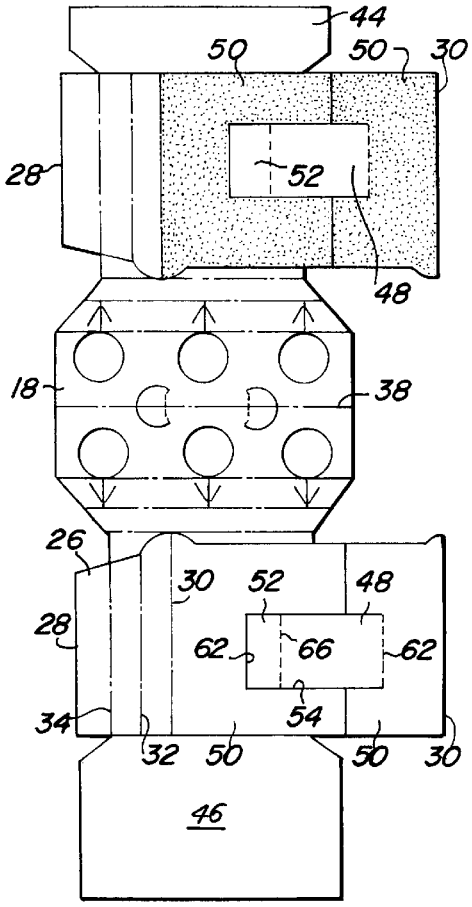
FIG. 7

BASKET CARRIER WITH TOP PANEL

FIELD OF THE INVENTION

This invention relates to a basket-style carrier for packaging articles such as beverage bottles. More particularly, it relates to a basket-style carrier incorporating a top panel.

BACKGROUND OF THE INVENTION

Basket-style carriers are commonly employed to package beverage bottles. They normally include a central handle panel located between spaced parallel side panels, a bottom panel connected to the side panels and end panels connected to both the side panels and the handle panel. Dividers extending from the handle panel to the side panels are commonly included to provide individual cells for glass bottles, in order to prevent undue contact between adjacent bottles. Typically, basket-style carriers of this type are fabricated from collapsed carriers which have been formed from blanks. The carriers are loaded either by dropping bottles into place after the bottom panel has been formed or by moving an opened carrier over the bottles and then forming the bottom panel. Packaging machines designed to load and form the finished basket carrier package are employed to rapidly carry out these operations.

Basket carriers are strong and easy to carry, and they add an overall impression of quality to the product. In some cases, however, it is desirable to package beverage bottles in substantially enclosed carriers, which provide even greater product security. This means that a packager must have a different specialized packaging machine designed to handle a different type of carrier, usually a sleeve-type enclosed carrier. This is not only an inconvenience, but it is also quite expensive to provide two separate machines. It would be much more convenient, and more economical, to be able to use the same machine to package bottles in either an enclosed or open-top basket-style carrier.

An object of the invention, therefore, is to provide an enclosed basket carrier which can be packaged on the same machine used to package conventional open basket carriers. The carrier must possess adequate strength and rigidity, and should also present a pleasing design appearance basically similar to the appearance of conventional basket carriers.

BRIEF SUMMARY OF THE INVENTION

The carrier of the invention is a basket-style carrier which includes a bottom panel, a pair of opposite side panels foldably connected to the bottom panel and a pair of opposite partial lower end panels foldably connected to the side panels. A center panel foldably connected to the end panels divides the carrier into article-receiving areas located between the side panels and the center panel. The carrier also includes a top panel which is foldably connected to the side panels and spaced from the partial lower end panels. With this arrangement a basket-style carrier having a top panel can be formed from a single blank. When used to package beverage bottles the top panel may be provided with bottle neck openings or it may be formed in such a way as to extend over the tops of the bottles. When the latter embodiment is employed partial upper end panels connected to the top panel extend down toward, but are spaced from, the partial lower end panels. In addition, vertical fold lines may be provided in the end panels to permit the end panels to more closely follow the contour of adjacent end bottles.

In the preferred arrangement each partial lower end panel is comprised of two end panel sections which are foldably connected to the side panels and the center panel. Cell-dividing partitions may extend between the center panel and the side panels. Preferably, the partitions are located so that they are flexed toward the center cell by the entry of articles into the end cells, thereby providing a tight fit. A handle in the form of finger openings in the top panel, or a handle flap extending up from the top panel or the edges of the top panel itself is provided. When employing the embodiment in which partial upper end panels are connected to the top panel, gusset panels automatically cause the upper end panel elements to fold into place during the carrier forming operation.

The carrier is readily formed from a single blank and can be packaged on the same machine used to package conventional basket carriers. It is not only strong and rigid, but presents a pleasing appearance as well.

These and other features and aspects of the invention will be readily ascertained from the detailed description of the preferred embodiments described below.

BRIEF DESCRIPTION OF THE DRAWING

FIG. 2 is an end view of the carrier of FIG. 1;

FIG. 3 is a transverse sectional view taken on line 3—3 of FIG. 2;

FIG. 6 is a plan view of the carrier blank after initial folding and gluing steps;

FIG. 7 is a plan view of the carrier blank after additional folding and gluing steps;

DETAILED DESCRIPTION OF THE PREFERRED EMBODIMENTS

Figure 1:
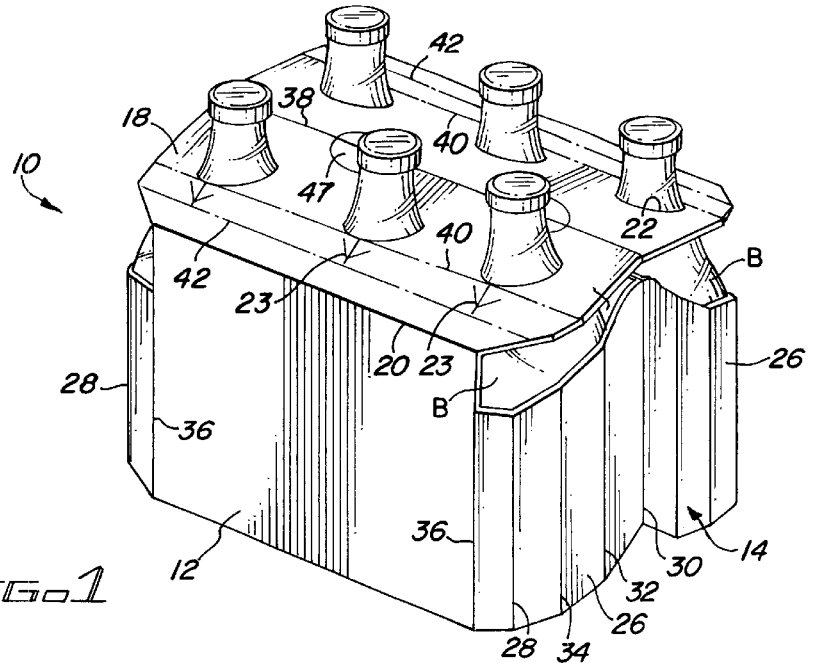
FIG. 1 is a pictorial view of a basket-style carrier incorporating the invention.

Referring to FIGS. 1 and 2, a first embodiment of the basket-style carrier 10 of the invention is comprised of opposite side panels 12 foldably connected to opposite partial lower end panels 14 and to bottom panel 16. A top panel 18, connected to the side panels by fold lines 20, includes openings 22 through which the necks of packaged bottles B extend and slits 23 which extend outwardly from the openings. The bottles are arranged in two rows of three per row, the rows being defined by the space between the side panels 12 and center panel 24. The center panel is not visible in FIG. 2 and is mainly obscured in FIG. 1 by the top panel 18 and the nearest end bottle. A small portion of it can be seen, however, in FIG. 1.

Each lower end panel is comprised of two sections 26, each being connected to a side panel 12 by fold line 28 and to the center panel 24 by fold line 30. Each section includes spaced vertical fold lines 32 and 34 which allow the section to substantially conform to the contour of the adjacent end bottle. Fold lines 36 in the side panels 12 serve the same function. The fold lines 28, 30, 32, 34 and 36 are parallel.

The top panel 18 includes a series of fold lines parallel to the fold lines 20. Fold line 38 extends along the centerline of the carrier, fold lines 40 extend along the outer edges of the bottle neck openings 22 and fold lines 42 extend between the fold lines 40 and 20. As illustrated in FIGS. 1 and 2, the top panel is slightly angled down from the center fold line 38. Also, as shown in FIG. 2, the bottom panel is comprised of adhered partially overlapping bottom panel flaps 44 and 46 which are foldably connected to the side panels 12. Finger holes covered with tabs 47 are provided along the center fold line 38.

Figure 4:
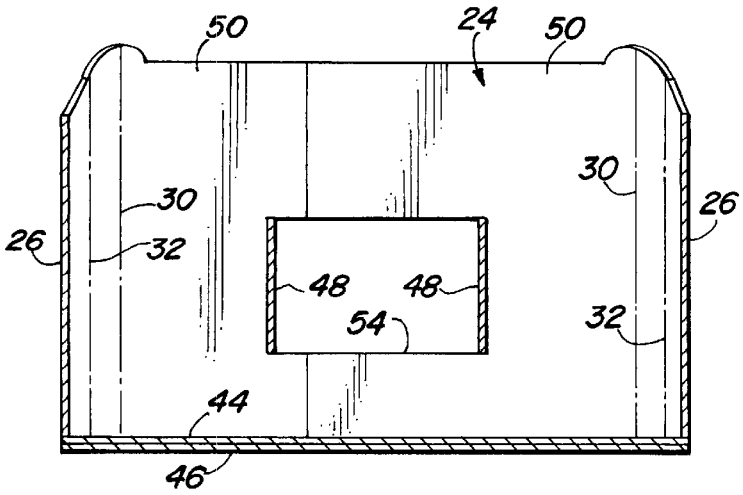
FIG. 4 is a longitudinal sectional view taken on line 4—4 of FIG. 3.

Referring to FIGS. 3 and 4, the carrier includes divider partitions 48 which separate the interior of the basket into individual bottle-receiving cells. Each partition is foldably connected to a ply 50 of the two-ply center panel 24 and is adhered to an associated side panel 12 by glue flap 52. The partitions are curved toward the middle bottle in each row, opposite the curve formed by the end panel sections. The center panel 24 is comprised of overlapping two-ply flaps, as will be described in greater detail below, resulting in a four-ply portion in the overlapping central portion of the center panel. As shown in FIG. 4, each partition 48 is formed from a portion of a center panel ply 50, leaving opening 54 in the center panel 24 corresponding to the shape of the partitions. It can be seen from FIGS. 3 and 4 that the distance from the point of contact between the divider partitions and the bottles to the outer extent of the end panel sections is equal to the diameter of the bottles, resulting in a tight fit between the bottles and the bottle-receiving cells formed by the partitions. It will be appreciated, however, that the distance between the partitions and the end panels prior to loading the bottles would be less than the distance between the partitions themselves. The location of the partition glue flaps 52 in FIG. 3 illustrates this relationship.

Figure 5:
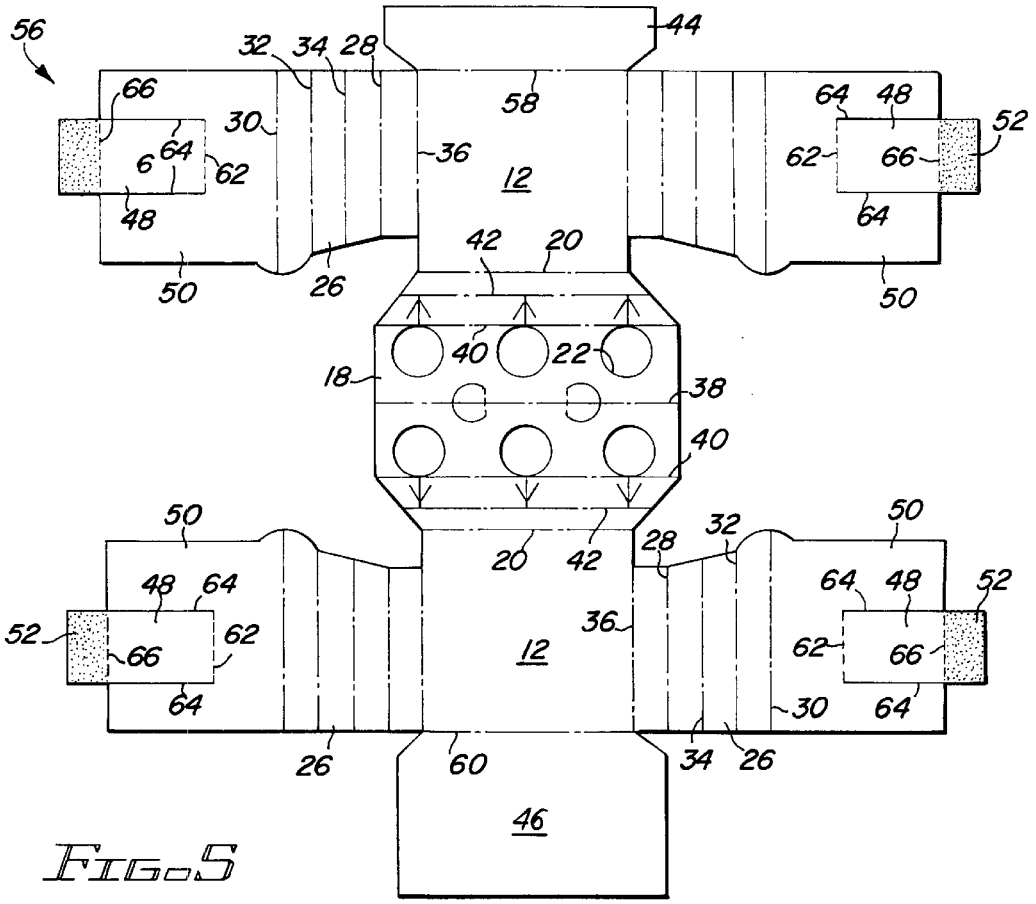
FIG. 5 is a plan view of a blank for fabricating the carrier.

Referring now to FIG. 5, a blank 56 for forming the carrier is comprised of paperboard or other suitably strong, flexible material. The center fold line 38 of top panel 18 basically divides the blank into two similar halves, except for the bottom panel flap 46 being larger than the bottom panel flap 44. Connected to the top panel by fold lines 20 are the side panel sections 12, which are connected by fold lines 58 and 60 to the bottom panel flaps 44 and 46, respectively. The end panel sections 26 are connected to the ends of side panel sections 12 by fold lines 28 and to the ends of the center panel ply flaps 50 by fold lines 30. The top panel includes all of the elements described above in connection with FIGS. 1–4, and the side and end panel sections include the fold lines described above. In addition, each center panel ply flap 50 includes fold line 62 and slits 64 which together define the divider partitions 48. The glue flaps 52 are connected to the partitions 48 by fold lines 66.

To form a carrier from the blank glue is applied to the partition glue flaps 52, as shown in stipple in FIG. 5, and the center panel plies 25 are pivoted inwardly about the fold lines 30. This adheres the glue flaps 52 to the side panel sections. The blank at this interim stage of the carrier forming operation appears as illustrated in FIG. 6.

Glue is then applied to the stippled areas of the center ply flaps 50 at the right of the interim blank of FIG. 6, after which the end panel sections on the left side of the blank are folded over about the fold lines 28. The end panel sections 26 are not visible in FIG. 6 because they are hidden by the folded center flaps 50. When the end panel sections are pivoted about the fold lines 28 the connected partition section 48 cannot swing with it due to the associated glue flap 52 being adhered to the adjacent side panel section 12. Thus when the end panel sections 26 are pivoted about fold lines 28 the associated partition section 48 folds inwardly about fold line 62 and outwardly about fold line 66, inverting the partition section so that the surface that was facing outwardly is now face down. This maneuver is possible because the distance between partition fold lines 62 and 66 is the same as the distance between the fold lines 28 and 30, thereby eliminating binding or unwanted folding of the pivoting elements during the pivoting step. The distance between partition fold lines 62 and 66 is also the same as the distance between the partition fold line 62 and the fold line 32, resulting in the fold line 32 of the folded end panel section overlying the fold line 62 of the partition section. The blank at this point is illustrated in FIG. 7. Note that the full partition section 48 from the right side of the blank is visible through the opening 54 in the left center panel flap 50, with the fold 62 of the reverse folded partition section at the left of the blank being aligned with the end of the glue flap 52 associated with the right side of the blank. Note also that the fingers of the left center panel flap 50 above and below the opening 54 are now adhered to the corresponding structure of the center panel flap 50 of the right side of the blank, creating a two-ply area where the center panel flaps overlap.

The final step in creating a collapsed carrier is to apply glue to the stippled area of at least one of the center panel flaps 50, as shown in FIG. 7, and to fold the blank about the center fold line 38. This step adheres the center panel flaps of the upper end of the blank to the center panel flaps of the lower end of the blank, creating the collapsed carrier shown in FIG. 8. The overlapped two-ply areas of the center panel section at the upper end of the blank are now adhered to the overlapped two-ply areas of the center panel section at the lower end of the blank, resulting in a portion of the center panel section of the carrier immediately adjacent the handle being of four-ply construction.

Figure 8:
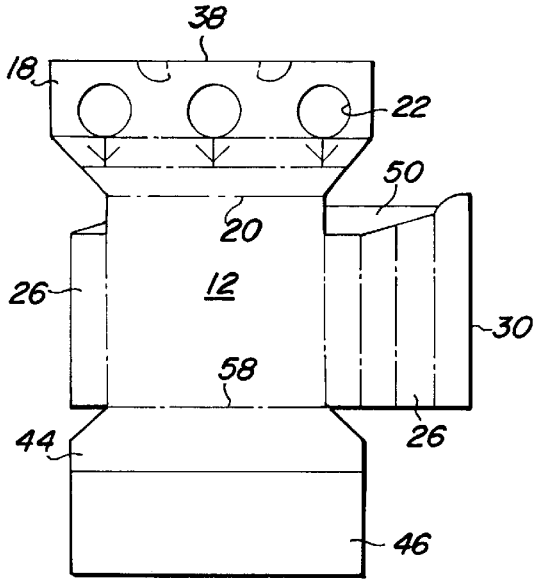
FIG. 8 is a plan view of a collapsed carrier resulting from a final folding and gluing step.

To form a package from the collapsed carrier of FIG. 8, inward pressure is applied to the end folds 28 and 30, which opens the collapsed carrier, causing the divider partitions to unfold and span the bottle receiving areas on each side of the center panel. The open carrier, with the bottom panel flaps still open, is then moved down over the bottles to be packaged. The bottles will have first been positioned in their final arrangement so that when the open carrier is moved down over them, the bottle necks are aligned with the openings in the top panel and the bottles are aligned with the cells created by the divider partitions. The bottle neck openings must be made larger than the bottle necks to permit the bottle necks to readily pass through the openings. The bias of the center fold line 38 tends to pivot the top panel back to its folded condition, causing the slightly tapered appearance shown best in FIG. 2. This causes the outer edges of the bottle neck openings to grip the bottle necks, with the slits 23 providing stress relief at these points. After the bottles have been loaded the bottom panel flaps are overlapped and adhered to each other, completing formation of the package.

As indicated above, the location of the divider partitions makes the end cells in the opened collapsed carrier narrower than the center cells. When the end bottles enter the end cells, the bottles force the end panel sections out and the divider partitions toward the center cells, flexing the carrier and the partitions into the shape shown in FIG. 3. As a result, the bottles fit very tightly in the bottle-receiving cells, with the vertical fold lines in the end panels facilitating the flexing of the end panels. The bottles are thus tightly held in place by the cells and by the bottle neck connection with the top panel, with virtually no chance of the bottles escaping the carrier or even moving within the carrier. There is no need for a riser panel to hold the handle panel in place, as is required in conventional basket carriers, since each ply of the center panel is connected directly to an end panel section.

Figure 9:
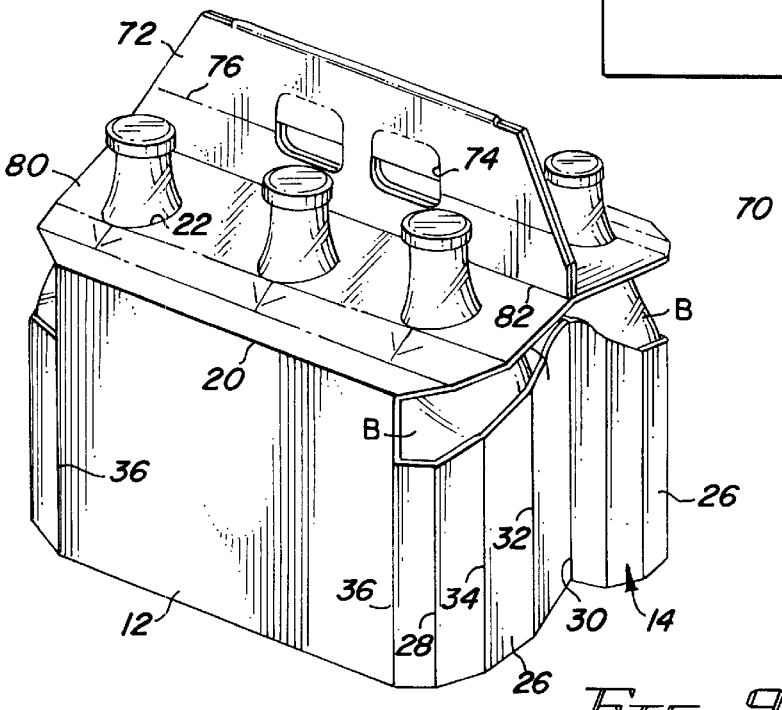
FIG. 9 is a pictorial view of another embodiment of the carrier of the invention.

Another embodiment of the invention is shown in FIG. 9. The carrier 70 is substantially the same as the carrier of FIG. 1 except for the top panel and the handle. Whereas in the first embodiment the handle consists of finger holes in the top panel, in this embodiment the handle is a separate vertical flap 72 containing finger openings 74. This arrangement is easier and more comfortable to grip for some people and provides an alternative to the handle arrangement of the first embodiment. A horizontal fold line 76 in the handle flap allows the handle portion above the fold line to be folded over to prevent it from extending up beyond the tops of the bottles. This allows the carriers to be stacked without interference from the handles. The top panel 80 is similar to the top panel of the first embodiment except for the fold lines 82 which connect the two plies of the handle flap to the top panel. The other reference numerals appearing in FIG. 9 are the same as those used in the drawing figures of the first embodiment and are used to denote similar elements.

Figure 10:
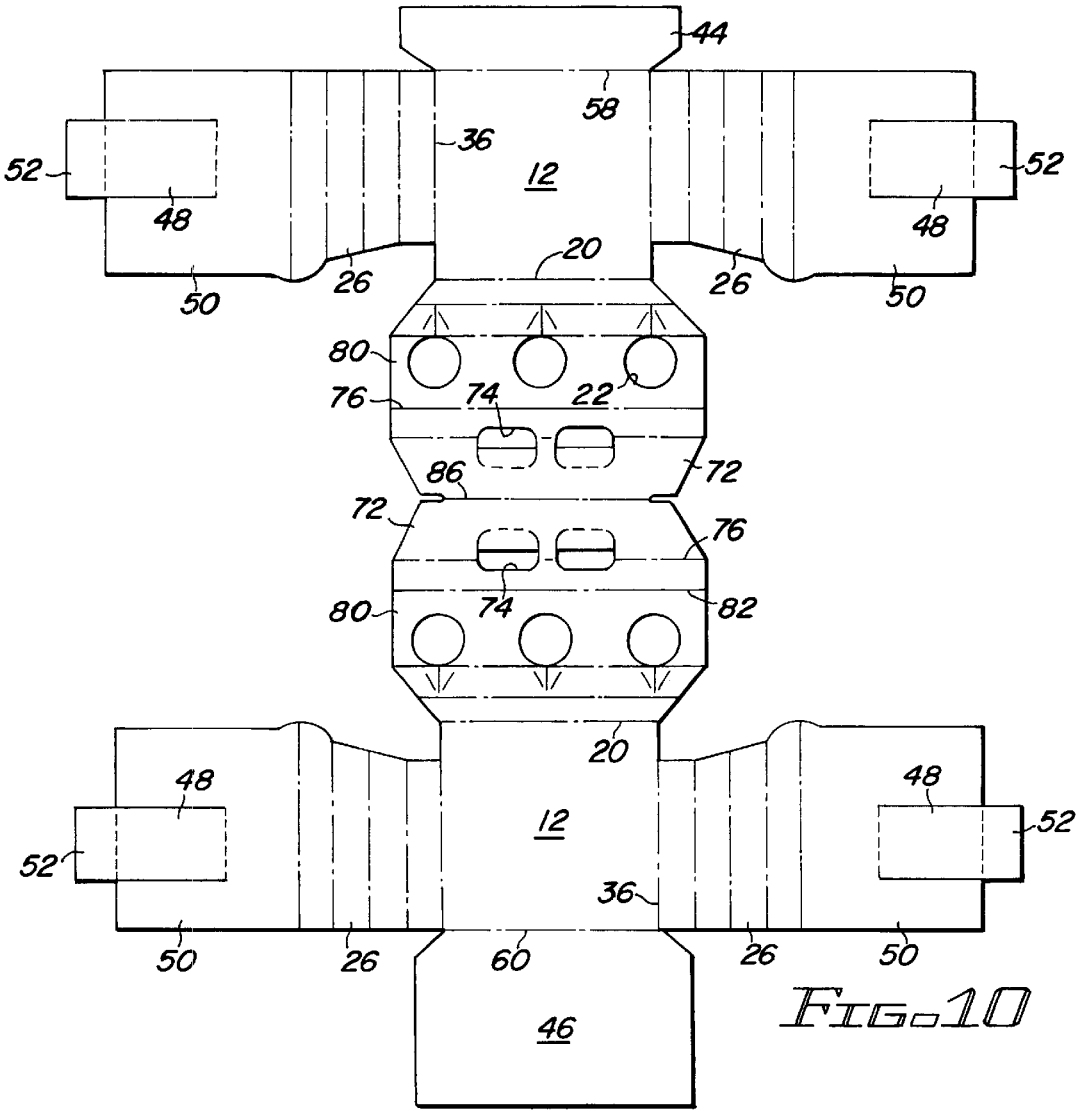
FIG. 10 is a plan view of a blank for forming the carrier embodiment of FIG. 9.

Referring to FIG. 10, the blank 84 used to form the carrier of FIG. 9 is similar to the blank shown in FIG. 5 except for the handle sections 72. The handle sections are connected to the top panel sections 80 by fold lines 82 and are connected to each other by center fold line 86. When forming a collapsed carrier from the blank, the procedure is the same as described in connection with the first embodiment, except that the fold line 86 is the centerline of the blank instead of the fold line 38 of the first embodiment. Also, when making the last fold, which glues the center panel sections together, glue is also applied to the handle flap sections 72 to adhere them to each other. Loading of the carrier is accomplished in the same manner as the carrier of the first embodiment.

Figure 11:
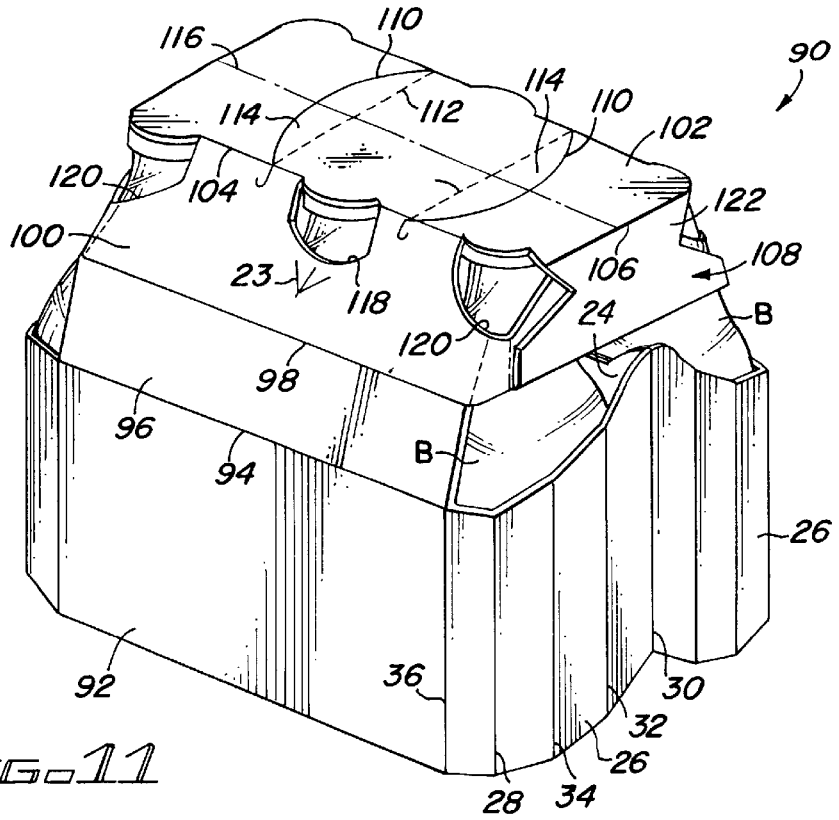
FIG. 11 is a pictorial view of a further embodiment of the carrier of the invention.

A third embodiment is illustrated in FIG. 11. The basic construction of the carrier 90 is similar to that of the first two embodiments, including a center panel 24 formed from extensions of the end panel sections 26. In this case, however, the top panel does not include openings through which the bottle necks extend, but instead covers the tops of the bottles. The side panels 92 include a horizontal fold line 94 which allows intermediate portion 96 of the side panels to fold inwardly against the tapered portions of adjacent bottles. Fold line 98 in the side panels connects the intermediate portion 96 to upper portion 100, which in turn is connected to top panel 102 by fold line 104. Connected to the end edges of the top panel by fold lines 106 are partial upper end panels 108. The top panel includes arcuate slits 110, which extend between the fold lines 104, and transverse fold lines 112, which also extend between the fold lines 104 at the juncture of the slits 110. When the short flaps 114 defined by the fold lines 112 and the slits 110 are pushed down between the adjacent bottles by the fingers of a user, the flaps and the area between the fold lines 112 form a handle for lifting the carrier. In addition, the top panel includes a center fold line 116.

The upper portions of the side panels further include center cutouts 118 and corner cutouts 120 which tightly contact adjacent bottle necks. The corner cutouts 120 extend into the partial upper end panels 108. Upper end panel flaps 122 and other structure, which is hidden in FIG. 11 but is described in detail below, make up the upper end panels 108.

Figure 13:
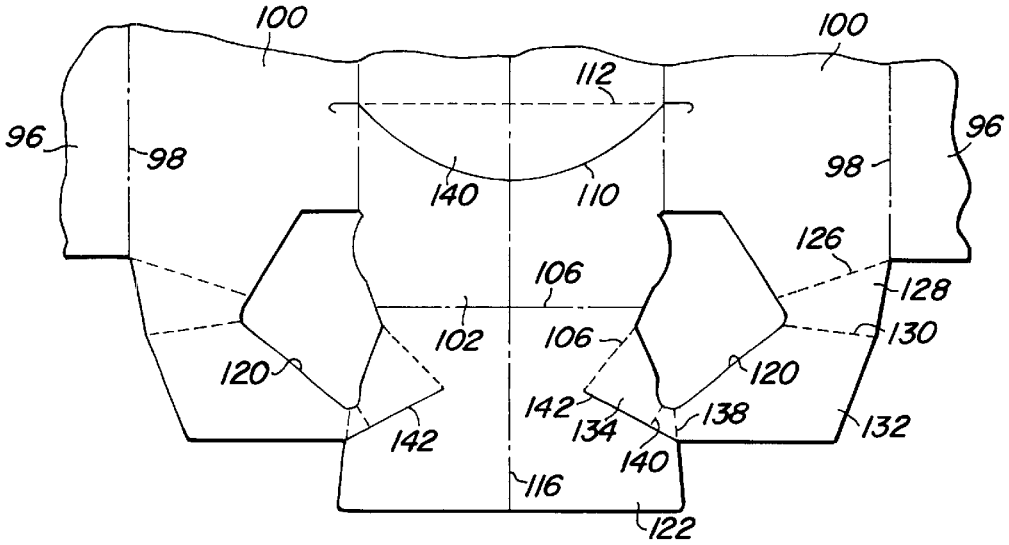
FIG. 13 is an enlarged plan view of the area of the blank of FIG. 12 indicated by numeral 13.
Figure 12:
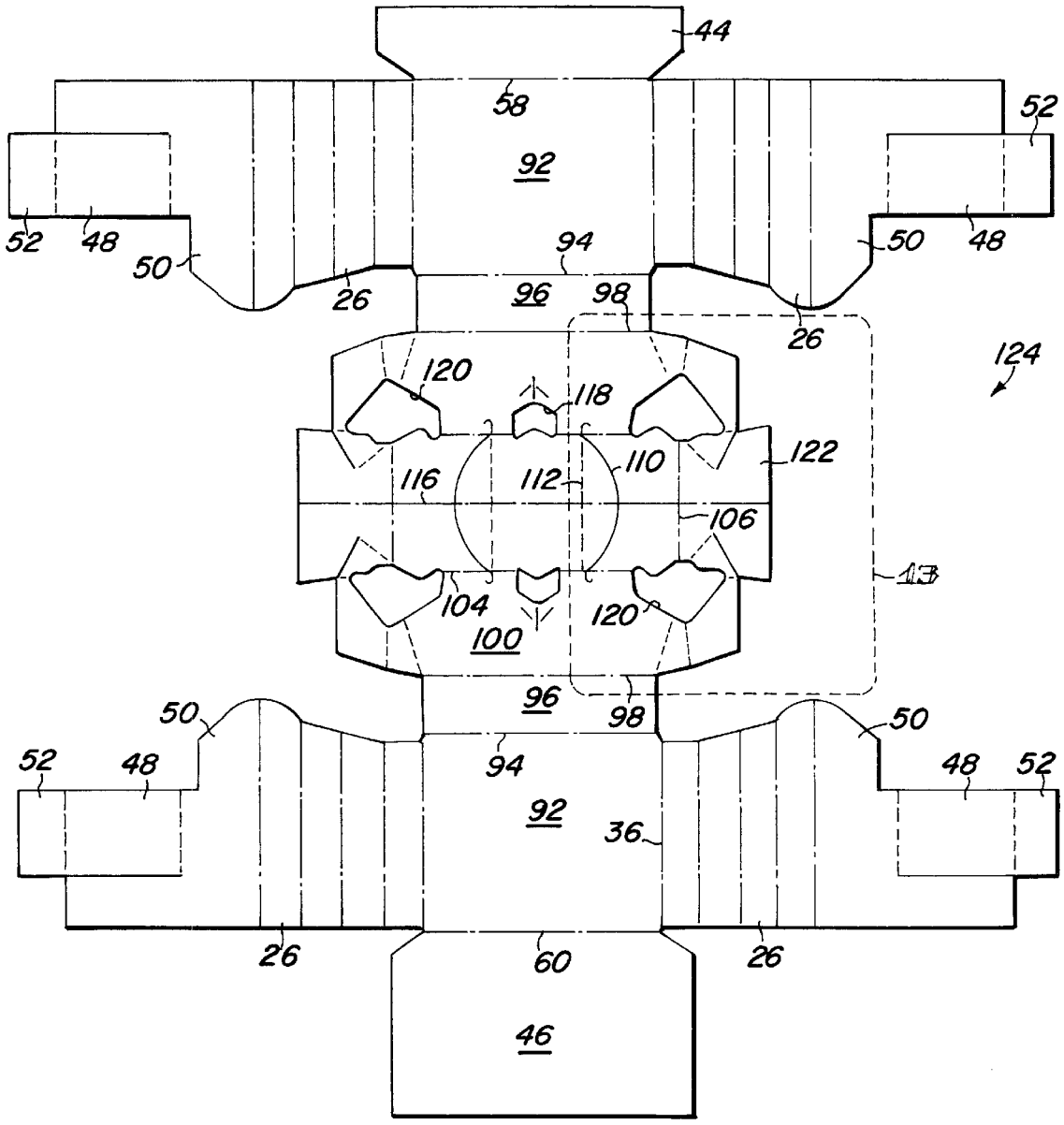
FIG. 12 is a plan view of a blank for forming the carrier embodiment of FIG. 11.

The blank 124 of FIG. 12 is similar in general layout to the blanks of the first two embodiments, but is different in specific details of the top panel and partial upper side panel sections. The enlarged portion of the blank shown in FIG. 13 show these differences in greater detail. The reference numerals in FIGS. 12 and 13 which are common to the reference numerals used in FIG. 11 denote like elements. Connected to the upper side panel portions 100 by fold lines 126 are upper corner panels 128, which in turn are connected by fold lines 130 to end glue flaps 132. Gusset panels 134 are connected to the upper end flaps 122 by fold lines 136 and are also foldably connected to the end glue flaps 132 by fold lines 138 and 140. The upper corner panels 128, the upper glue flaps 132 and the gusset panels 134 all have an edge forming part of the associated cutout 120. The gusset panels 134 are also separated from the upper end flaps 122 by slits 142.

Figure 14:
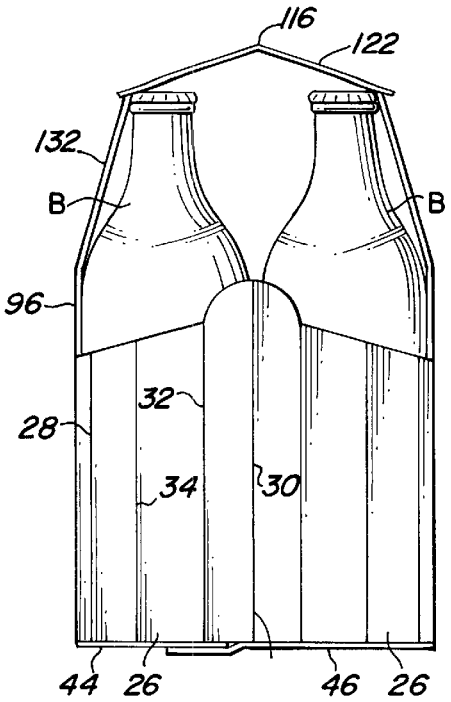
FIG. 14 is an end view of an opened carrier formed from the blank of FIG. 12, after the carrier has been lowered over a group of bottles but is at an interim stage of completion.
Figure 15:
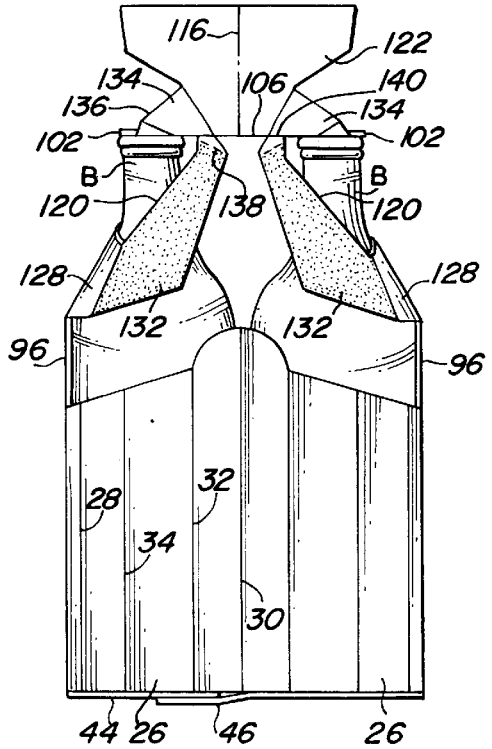
FIG. 15 is an end view of the opened carrier of FIG. 14 after the next step in the carrier forming process.

A collapsed carrier is formed from blank 124 by the same procedure outlined in connection with the first embodiment. To form a package, the collapsed carrier is opened and lowered over a group of bottles, reaching the point illustrated in FIG. 14 where the top panel has not yet been fully formed. The next step, which is illustrated in FIG. 15, requires the upper end panel flaps 122 to be folded up about the fold lines 106. Because the gusset panel fold lines 136 move with the upper end panel flaps, the gusset panels 134 are caused to fold down about the fold lines 136, forcing the connected end panel glue flaps 132 to be moved to the positions shown in FIG. 15. This also moves the connected corner panels 128 into position. To complete formation of the upper end panels it is merely necessary to pivot the upper end panel flaps 122 down about their fold lines 106, after having applied glue to the glue flaps 132, as shown in stipple in FIG. 15. This brings the upper end panel flaps into contact with the glue flaps, adhering them together. In the process, the downward folding of the upper end panel flaps 122 causes the gusset panels 134 to fold down about the fold lines 138 and 140, so as to lie between the upper end panel flaps 122 and the glue flaps 132, in face-to-face contact with both.

It will be understood that because of the narrow neck of the gusset panels 134 at the point of their foldable connection to the upper end panel flaps 122, a double fold connection as described is preferred. A single fold line may be employed, however, if it is determined that there is little likelihood of the gusset panels tearing at the foldable connection during the carrier forming process.

The arrangement of the third embodiment results in the bottles being held tightly in place by the side panels, the upper end panels and the top panel. In addition, the partial upper end panels are automatically formed merely by a first upward pivoting movement followed by a downward pivoting movement of the upper end panel flaps. The partial upper end panel is locked into place by the gusset panel arrangement. The partial lower end panels also tightly fit about the end bottles due to the folded design discussed above. An added advantage of this design is the additional area afforded by the full top panel and continuous partial upper end panel able to receive graphics.

Figure 16:
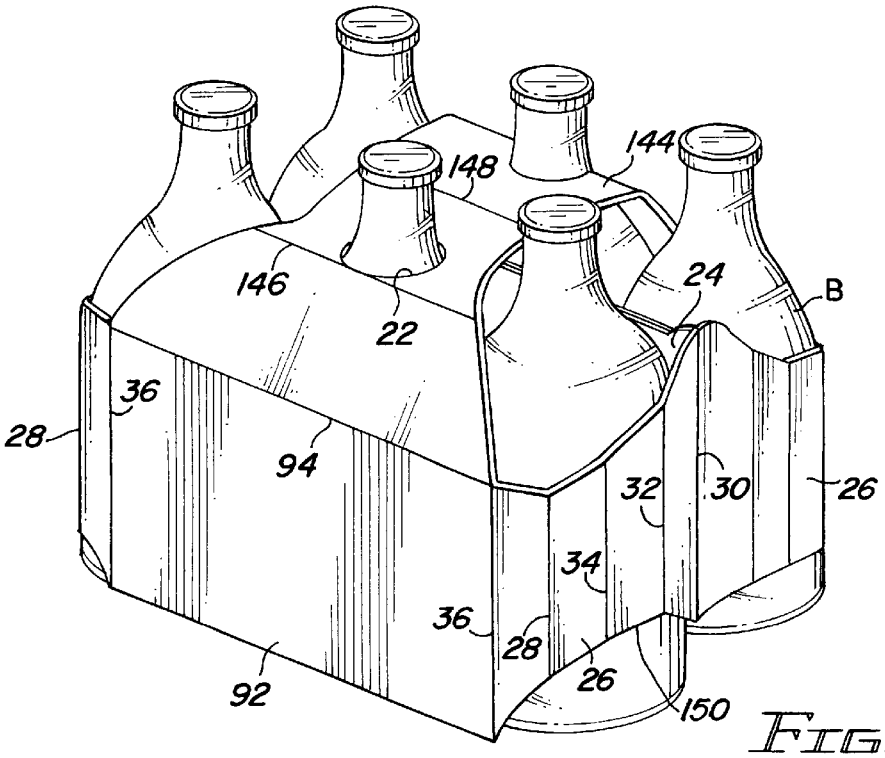
FIG. 16 is a pictorial view of still another embodiment of the invention.

A fourth embodiment is illustrated in FIG. 16 which, like the carrier of FIG. 1, has a top panel 144 connected to the side panels 92 by fold lines 94. In this arrangement, however, the top panel tapers inwardly to form a narrow portion, the end edges of which extend between the center and the end bottles. The top panel includes bottle neck openings 22, but only the necks of the middle bottles extend through them, the other bottle necks remaining uncovered. The top panel includes intermediate fold lines 146 extending along the outer ends of the openings 22 and a center fold line 148. The carrier is intended to be lifted by the end portions of the top panel, which is narrow enough to allow the thumb and fingers of a user to grasp the top panel and use it as a handle. Handle flaps may be provided along the end edges of the top panel to provide better support and to make the grip more comfortable. The end panel sections 26 are similar to the end panel sections of the other embodiments in that they conform to the shape of the end bottles, but in addition they include a cutout 150 in the lower portion which spaces the lower edges of the end panels from the plane of the bottom panel. This allows the lower portions of the end bottles to be seen, so that in combination with the curvature of the end panels and the exposed upper bottle portions the full outline of the end bottles may be appreciated.

Figure 17:
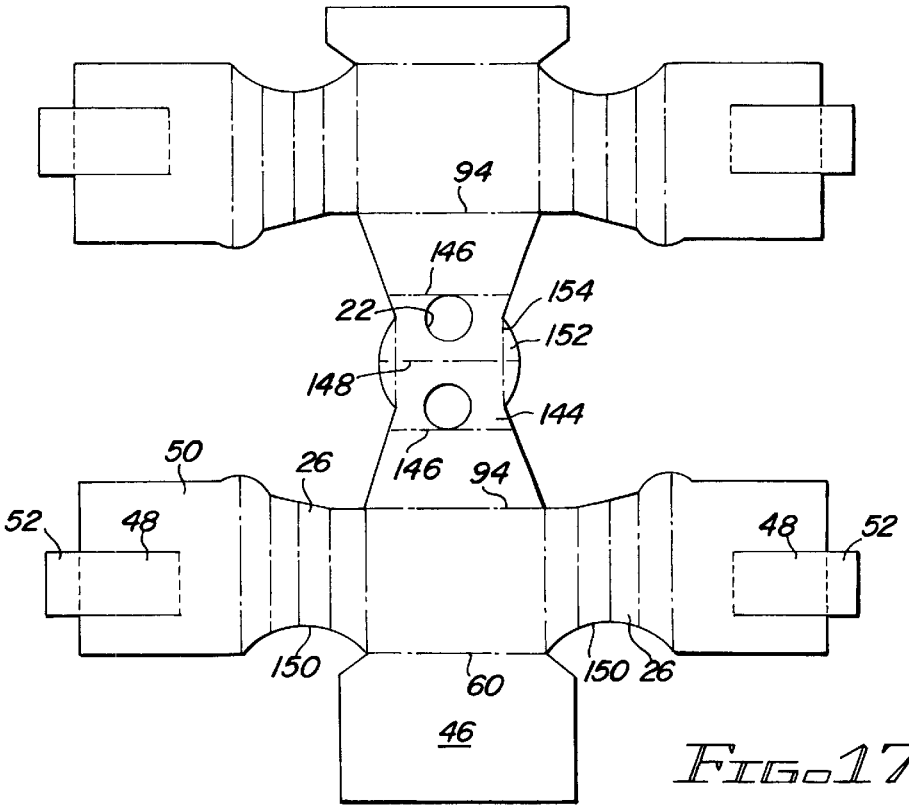
FIG. 17 is a plan view of a blank for forming the carrier embodiment of FIG. 16.

A blank for forming the carrier of FIG. 16 is illustrated in FIG. 17. The general layout of the blank is similar to the general layout of the blank of the first embodiment, with the specific differences noted above being included. The end handle flaps 152 are shown as being connected by fold lines 154 to the outer edges of the top panel section 144. Also, the lower cutouts 150 of the end panels are illustrated as being inwardly curved edges of each end panel section.

The manner of forming the blank into a collapsed carrier and the manner of forming the finished carrier from the collapsed carrier are similar to the procedures described above. The divider partition flaps are located as in the other embodiments.

It can now be appreciated that the invention provides unique basket-style carrier which may employ top panels differing in detail but nonetheless all providing for a tight fit with the packaged articles. The carrier is quite sturdy and capable of being formed on a basket-style packaging machine.

The thickness of the paperboard has been exaggerated in the drawings for the sake of clarity. It will be understood that in the actual carrier the thickness of the panels is quite small compared to the dimensions of the carrier.

It should be understood that the invention is not limited to all the specific details described in connection with the preferred embodiments, except as they may be within the scope of the appended claims, and that changes to certain features of the preferred embodiment which do not alter the overall basic function and concept of the invention are contemplated.

What is claimed is:

1. A basket-style carrier, comprising:

a bottom panel;

a pair of opposite side panels foldably connected to the bottom panel;

a pair of opposite partial lower end panels foldably connected to the side panels;

a center panel foldably connected to the partial lower end panels, the center panel dividing the carrier into article-receiving areas between the side panels and the center panel; and a top panel foldably connected to the side panels, the top panel being spaced from the partial lower end panels.

2. A basket-style carrier as defined in claim 1, wherein each partial lower end panel is comprised of two end panel sections, each end panel section having an end which is foldably connected to an associated side panel and an opposite end which is foldably connected to the center panel.

3. A basket-style carrier as defined in claim 2, wherein the center panel is comprised of two connected sections, each center panel section being of two-ply construction, each ply of the center panel sections being foldably connected to an end panel section.

4. A basket-style carrier as defined in claim 2, wherein each end panel section contains a plurality of substantially vertical fold lines, whereby the end panel sections can be folded about the fold lines so as to be able to conform to adjacent curved surfaces of articles which may be packaged in the carrier.

5. A basket-style carrier as defined in claim 2, wherein the end panel sections have lower edges which are spaced from the plane in which the bottom panel lies, providing open areas through which the lower portions of articles which may be packaged in the carrier can be seen.

6. A basket-style carrier as defined in claim 1, wherein the carrier includes cell-dividing partitions extending between the center panel and the side panels.

7. A basket-style carrier as defined in claim 6, wherein the distance between the partitions and the nearest end panel is less than the distance between the partitions.

8. A basket-style carrier as defined in claim 6, wherein each partition is foldably connected to the center panel and is adhered by a foldably connected glue flap to a side panel.

9. A basket-style carrier as defined in claim 1, wherein the top panel includes a handle.

10. A basket-style carrier as defined in claim 9, wherein the handle is comprised of openings in the top panel.

11. A basket-style carrier as defined in claim 9, wherein the handle is comprised of a handle flap foldably connected to the top panel, the handle flap containing openings therein.

12. A basket-style carrier as defined in claim 9, wherein the top panel has end edges which are spaced a substantial distance from the end panels, end portions of the top panel forming the handle.

13. A basket-style carrier as defined in claim 1, wherein the top panel includes openings for receiving upper portions of articles which may be packaged in the carrier.

14. A basket-style carrier as defined in claim 1, wherein the top panel has opposite end edges foldably connected to opposite partial upper end panels, the partial upper end panels being spaced from the partial lower end panels.

15. A basket-style carrier as defined in claim 14, wherein the partial upper end panels are also connected to the side panels.

16. A basket-style carrier as defined in claim 14, wherein each partial upper end panel is comprised of a flap foldably connected to an associated end edge of the top panel, the flap being adhered to end panel glue flaps connected to the side panels.

17. A basket-style carrier as defined in claim 16, wherein each partial upper end panel includes two gusset panels, each gusset panel being foldably connected to an associated upper end panel flap and to an end panel glue flap.

18. A basket-style carrier as defined in claim 17, wherein the partial upper end panels and the side panels meet at upper corners of the carrier, each upper corner having a cutout therein for receiving at least a partially protruding packaged article.

19. A basket-style carrier as defined in claim 13, wherein the top panel is relatively narrow, being substantially spaced from the end panels.

20. A blank for forming a basket-style carrier, comprising:

a top panel section having opposite side edges;

each side edge of the top panel section being connected by a fold line to a side panel section, each side panel section having opposite end edges;

each end edge of the side panel section being connected by a fold line to an end edge of a lower end panel section;

each lower end panel section having an opposite end edge connected by a fold line to a center panel flap; and bottom panel flaps connected by fold lines to the side panel sections;

whereby the blank can be formed into a carrier having a two-ply center panel connected to partial lower end panels comprised of the lower end panel sections, and a top panel spaced from the partial lower end panels.

21. A blank as defined in claim 20, wherein each lower end panel section contains a plurality of fold lines substantially parallel to the end edges of the side panel sections, whereby the end panel sections of a carrier formed from the blank can be folded about the fold lines so as to be able to conform to adjacent curved surfaces of articles which may be packaged in such a carrier.

22. A blank as defined in claim 20, wherein the blank includes cell-dividing partition flaps foldably connected to the center panel flaps, each partition flap including a foldably connected glue flap, the location of the partition flaps being such that the distance between the partition flaps and the nearest end panel in a carrier formed from the blank is less than the distance between the partitions.

23. A blank as defined in claim 20, wherein the top panel section includes carrier handle openings therein.

24. A blank as defined in claim 20, wherein the top panel section includes a foldably connected handle section, the handle section containing a center fold line and handle openings on each side of the center fold line, whereby the handle sections can be folded up from the top panel section in a carrier formed from the blank to form a handle flap.

25. A blank as defined in claim 20, wherein the top panel section includes openings for receiving upper portions of articles packaged in a carrier formed from the blank.

26. A blank as defined in claim 20, wherein the top panel section has opposite end edges foldably connected to upper end panel flaps, the side panel sections being foldably connected to upper end panel glue flaps.

27. A blank as defined in claim 26, wherein each upper end panel flap is foldably connected to two gusset panels, each gusset panel being foldably connected to an associated end panel glue flap.

28. A blank as defined in claim 27, wherein the blank includes cutouts between adjacent portions of the top panel section, the upper end panel flaps, the side panel sections and the end panel glue flaps, whereby each upper corner of a carrier formed from the blank has a cutout therein for receiving at least a partially protruding packaged article.

* * * * *